US006386844B1

(12) United States Patent
Chen et al.

(10) Patent No.: US 6,386,844 B1
(45) Date of Patent: May 14, 2002

(54) MINIATURE LIQUID TRANSFER PUMP AND METHOD OF MANUFACTURING SAME

(75) Inventors: Shiaw-Jong Steve Chen, Plano; Roger J. Hooey, Rockwall, both of TX (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/505,086

(22) Filed: Feb. 16, 2000

(51) Int. Cl.[7] ..... F04B 17/03

(52) U.S. Cl. ..... 417/423.15; 415/214.1; 417/423.14

(58) Field of Search ..... 417/423.1, 423.14, 417/423.15; 415/214.1, 215.1, 224, 225

(56) References Cited

U.S. PATENT DOCUMENTS 2,622,537 A * 12/1952 Wortendyke ..... 417/423.14
2,931,307 A * 4/1960 Smith ..... 417/423.1
2,969,908 A * 1/1961 Dallenbach ..... 417/423.1
3,306,222 A * 2/1967 Simcox ..... 417/423.14
3,847,505 A * 11/1974 Treese ..... 415/224
4,076,179 A * 2/1978 Tsukube ..... 415/225
4,308,994 A * 1/1982 Perhats ..... 417/423.1
5,100,288 A * 3/1992 Stanislao ..... 415/225
5,835,350 A 11/1998 Stevens ..... 361/704
6,000,919 A * 12/1999 Hsieh ..... 417/423.15
6,053,708 A * 4/2000 Nishikawa ..... 417/423.15
6,077,037 A * 6/2000 Schmidt ..... 415/214.1
6,210,101 B1 * 4/2001 Horng ..... 415/214.1

* cited by examiner

*Primary Examiner*—Michael Koczo
(74) *Attorney, Agent, or Firm*—Hitt Gaines & Boisbrun

(57) ABSTRACT

The present invention provides a miniature liquid transfer pump. The pump has a housing that includes first and second blocks joinable to form a leak-resistant impeller chamber with a drive shaft aperture, an inlet and an outlet. An impeller is located in the impeller chamber and a micro-motor with a drive shaft extending therefrom is mounted to the housing. The drive shaft on the micro-motor passes through the drive shaft aperture and engages the impeller. The micro-motor drives the impeller to draw liquid through the inlet and eject the liquid through the outlet.

24 Claims, 9 Drawing Sheets

MINIATURE LIQUID TRANSFER PUMP AND METHOD OF MANUFACTURING SAME

TECHNICAL FIELD OF THE INVENTION

The present invention is directed, in general, to a pump, and, more specifically, to a miniature pump used to move a liquid and that is powered by a micro-motor.

BACKGROUND OF THE INVENTION

The increased emphasis on miniaturization in industries such as electronics and medicine has created a demand for miniaturization of several devices that would otherwise become obsolete solely for reasons of size. For example, a traditional method of containing temperature build-up in electronic circuitry is to associate an active cooling device, such as a fan, with a printed wiring or circuit board. The fan moves cooling air over the circuitry and thereby increases the rate of thermal transfer from the circuitry to the surrounding ambient environment. A small fan is conventionally used in this fashion to cool a computer motherboard. The same fan, however, is rendered obsolete when more compact electronic circuits and devices require cooling. This is why smaller, and even miniature, fans have been developed for cooling smaller electronic circuits and components.

As a general rule, the most efficient heat control takes place when a heat-generating circuit or component is directly associated with a heat transfer device. Prior art finned heat sinks, for example, frequently have one or more heat generating components directly attached to the heat sink itself. This configuration permits the heat sink to absorb heat directly from the component or circuit and transfer the heat to the surrounding ambient air.

Although traditional passive heat control methods, such as heat sinks, have been successfully employed to cool compact electronic devices, in some cases the problems associated with temperature control have become so pronounced that passive devices are no longer sufficient. This is particularly true for electronic circuits that are small and complex. The circuit complexity results in a larger number of more powerful circuit components that generate large amounts of heat, the removal of which is further complicated by the reduced size of the electronics system. In some instances, not only does the classic finned heat sink not provide the requisite level of temperature control, but some active cooling devices, such as fans, are also inadequate. In such cases even more aggressive heat control measures must be taken. One such aggressive technique is to circulate a coolant fluid to gather heat and transfer it to a place where it can be radiated into the surrounding ambient air. The use of a liquid coolant to provide heat control for smaller electronic circuits and devices has its own set of problems. One such problem is keeping the liquid coolant moving through a predetermined cooling path.

Accordingly, what is needed in the art is a miniature pump that can be used to move useful quantities of liquid and that can be associated with active cooling devices used to provide temperature control for small electronic components and circuits.

SUMMARY OF THE INVENTION

To address the above-discussed deficiencies of the prior art, the present invention provides a miniature liquid transfer pump. The pump has a housing that includes first and second blocks joinable to form a leak-resistant impeller chamber with a drive shaft aperture, an inlet and an outlet. An impeller is located in the impeller chamber and a micro-motor with a drive shaft extending therefrom is mounted to the housing. The drive shaft on the micro-motor passes through the drive shaft aperture and engages the impeller. The micro-motor drives the impeller to draw liquid through the inlet and eject the liquid through the outlet.

The present invention therefore, in broad scope, introduces a miniature pump useful for moving liquids from a source to a destination in environments where larger pumps cannot be used for one reason or another. For example, prior art pumps are, in most cases, not suitable for moving liquid coolant when used as an active heat transfer device for cooling electronic equipment in a confined space. The invention provides for a pump that can be used in such an environment. Such a pump is also useful, for example, in moving liquid medicines in a hospital environment and in moving certain chemicals in a manufacturing environment.

In one embodiment of the pump, the impeller has a vane with a notch thereon, which embodiment is illustrated and described in more detail herein. This aspect of the invention is particularly beneficial because the pump can move greater quantities of liquid than it could otherwise move were the notch not present. In another embodiment, the pump uses an impeller with a flat vane. In another particularly useful embodiment of the invention, a sealing plate is located on the impeller, transversely oriented to the rotational axis of the impeller, to improve the leak-resistant characteristics of the impeller chamber.

In still another embodiment, the pump has a mounting plate with a mounting plate aperture therein. The mounting plate is coupled to the housing adjacent to the micro-motor so that the drive shaft on the micro-motor passes through the mounting plate aperture before passing through the drive shaft aperture of the impeller chamber.

Another embodiment of the invention, provides for an alignment feature to be located on the surface of one of the first and second blocks that is joinable to the surface of the other block which has an alignment feature receptacle. In one aspect of the invention, the pump has a clip securing the first and second blocks together.

To buffer the flow of fluid through the pump, a particularly useful embodiment of the invention provides for the inlet to have a fluid reservoir coupled to it. Another aspect of this embodiment provides for a clip to secure the reservoir to the housing. In still another embodiment of the invention, the housing of the pump has a block shape. In one aspect of this embodiment, each side of the block shape has a dimension of less than about one inch.

Other embodiments of the invention include methods of manufacturing a miniature liquid transfer pump. In one embodiment, the method comprises forming a housing that includes first and second blocks joinable to form a leak-resistant impeller chamber having a drive shaft aperture, an inlet and an outlet. An impeller is formed and located in the impeller chamber. A micro-motor with a drive shaft extending therefrom is mounted to the housing such that the drive shaft passes through the drive shaft aperture and engages and drives the impeller to draw liquid through the inlet and eject it through the outlet.

Yet another aspect of the invention provides for a liquid transfer device for transporting a liquid from one location to another. In one embodiment, a liquid transfer device comprises a pipe with a source end and a destination end with a miniature liquid transfer pump coupled to the pipe to move liquid through the pipe.

The foregoing has outlined, rather broadly, preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention in its broadest form.

BRIEF DESCRIPTION OF THE DRAWINGS

For a more complete understanding of the present invention, reference is now made to the following descriptions taken in conjunction with the accompanying drawings, in which.

DETAILED DESCRIPTION

Figure 1:
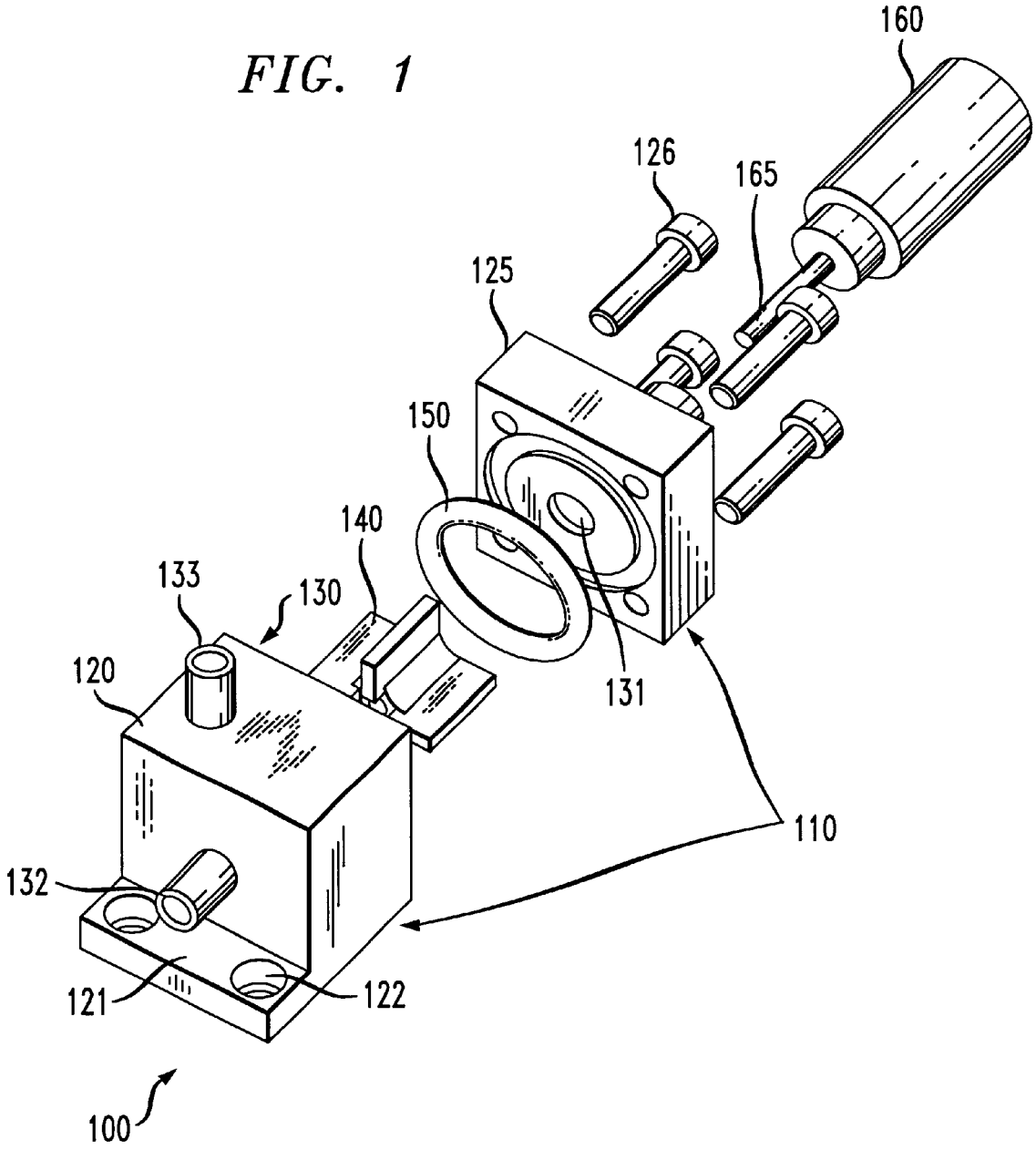
FIG. 1 illustrates an exploded isometric view of an embodiment of a miniature liquid transfer pump constructed in accordance with the principles of the present invention.

Referring initially to FIG. 1, illustrated is an exploded isometric view of one embodiment of a miniature liquid transfer pump 100 constructed in accordance with the present invention. The pump 100 has a housing 110 including first and second blocks 120, 125, which may have a substantially rectilinear shape, that are joinable to form a leak-resistant impeller chamber 130 (not visible) with a drive shaft aperture 131, an inlet 132 and an outlet 133. An impeller 140 is located in the impeller chamber 130. To increase the leak resistance of the impeller chamber 130, an impeller chamber o-ring seal 150 is located at the juncture of the first 120 and second 125 blocks.

To drive the impeller 140, the pump 100 has a micro-motor 160 with a drive shaft 165 extending therefrom. The micro-motor 160 is mounted to the housing 110 with the drive shaft 165 passing through the drive shaft aperture 131 to engage the impeller 140. The micro-motor 160 drives the impeller 140 in a rotary motion to draw liquid in through the inlet aperture 132 and eject the liquid through the outlet aperture 133. A miniature pump 100 constructed in accordance with the invention achieve- a flow rate of between about 0.2 gallons and about five gallons of liquid per hour.

It should be apparent to those skilled in the pertinent art, however, that the miniature pump 100 can be adapted to accommodate different flow rates by changing the size, or output power, of the micro-motor 160 or the size of the inlet aperture 132, outlet aperture 133 or both. Vanes of the impeller 140 can also be numbered and configured in various other known ways to provide efficient liquid flow at different flow rates.

The illustrated embodiment of the invention has four pins 126 that register the first and second blocks 120, 125 with respect to one another and, if threaded, can be employed to join the first and second blocks 120, 125 together. Also located on one edge of the housing 110 (in this instance, the first block 120) is a mounting flange 121 with mounting holes 122 therein that can be used to fasten the pump 100 to a supporting surface.

Figure 2:
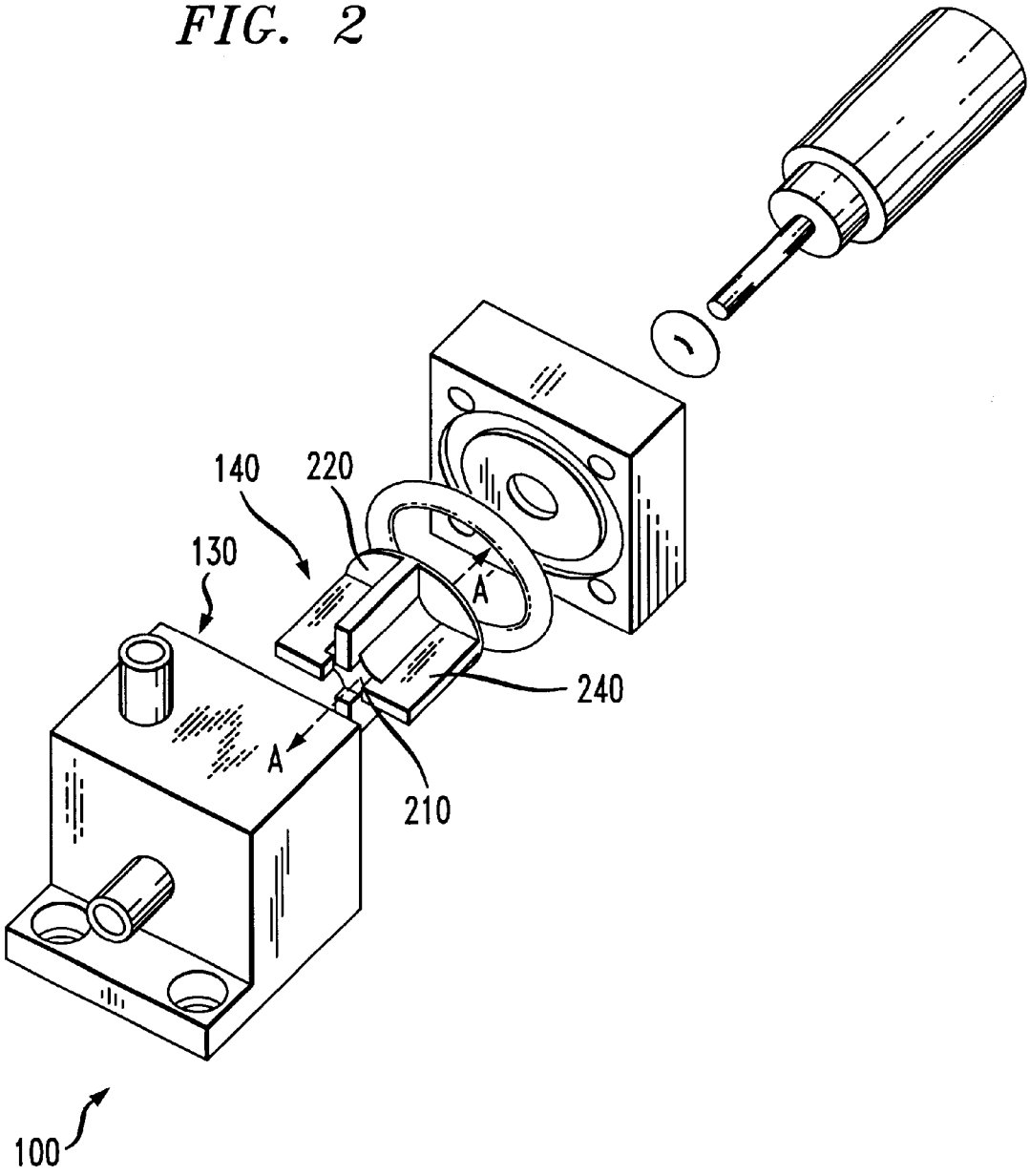
FIG. 2 illustrates an exploded isometric view of an embodiment of a miniature liquid transfer pump incorporating a notch on each vane of the impeller and a sealing plate.

Turning to FIG. 2, illustrated is an exploded isometric view of a miniature liquid transfer pump 100 highlighting two optional features of the invention. One such feature is a notch 210 located on each vane 240 of the impeller 140. The notch 210 advantageously increases the volume of liquid that the pump 100 can move over a given time period.

The other such feature is a sealing plate 220 located on the impeller 140. The sealing plate 220 is oriented transversely to a rotational axis A—A' of the impeller 140 and helps render the impeller chamber 130 leak resistant.

Figure 3:
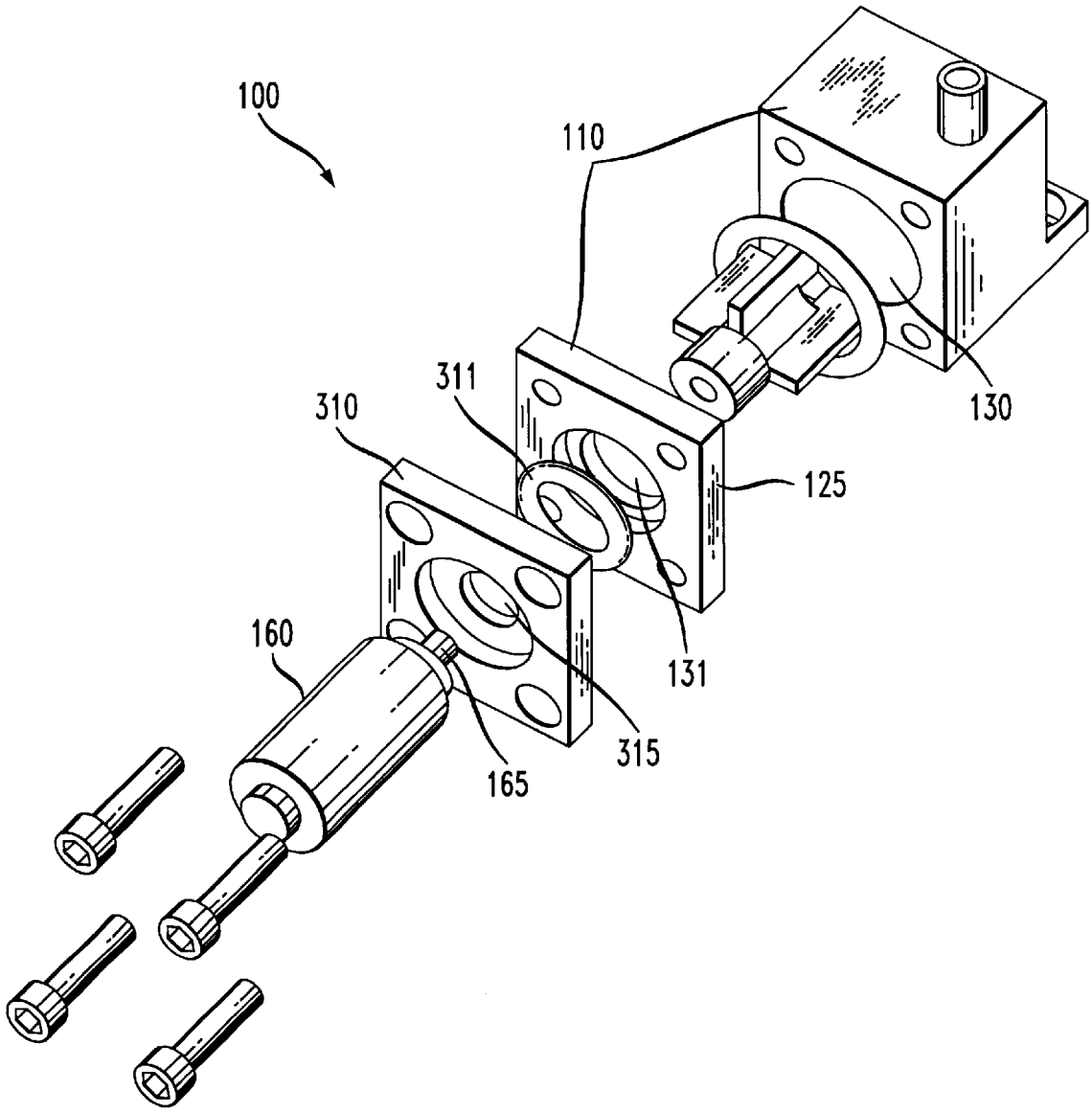
FIG. 3 illustrates an exploded isometric view of an embodiment of a miniature liquid transfer pump with a mounting plate couplable to the housing.

Turning now to FIG. 3, illustrated is an exploded isometric view of an embodiment of the miniature liquid transfer pump 100 with a mounting plate 310. The mounting plate 310 is coupled to the housing 110 adjacent to the micro-motor 160 so that the drive shaft 165 on the micro-motor 160 passes through a mounting plate aperture 315 in the mounting plate 310, before passing through the drive shaft aperture 131 of the impeller chamber 130. The mounting plate 310 provides additional stiffness and rigidity to the micro-motor 160. Also illustrated is a mounting plate o-ring seal 311 located between the second block 125 and the mounting plate 310 to aid in keeping the impeller chamber 130 leak-resistant.

Figure 4A:
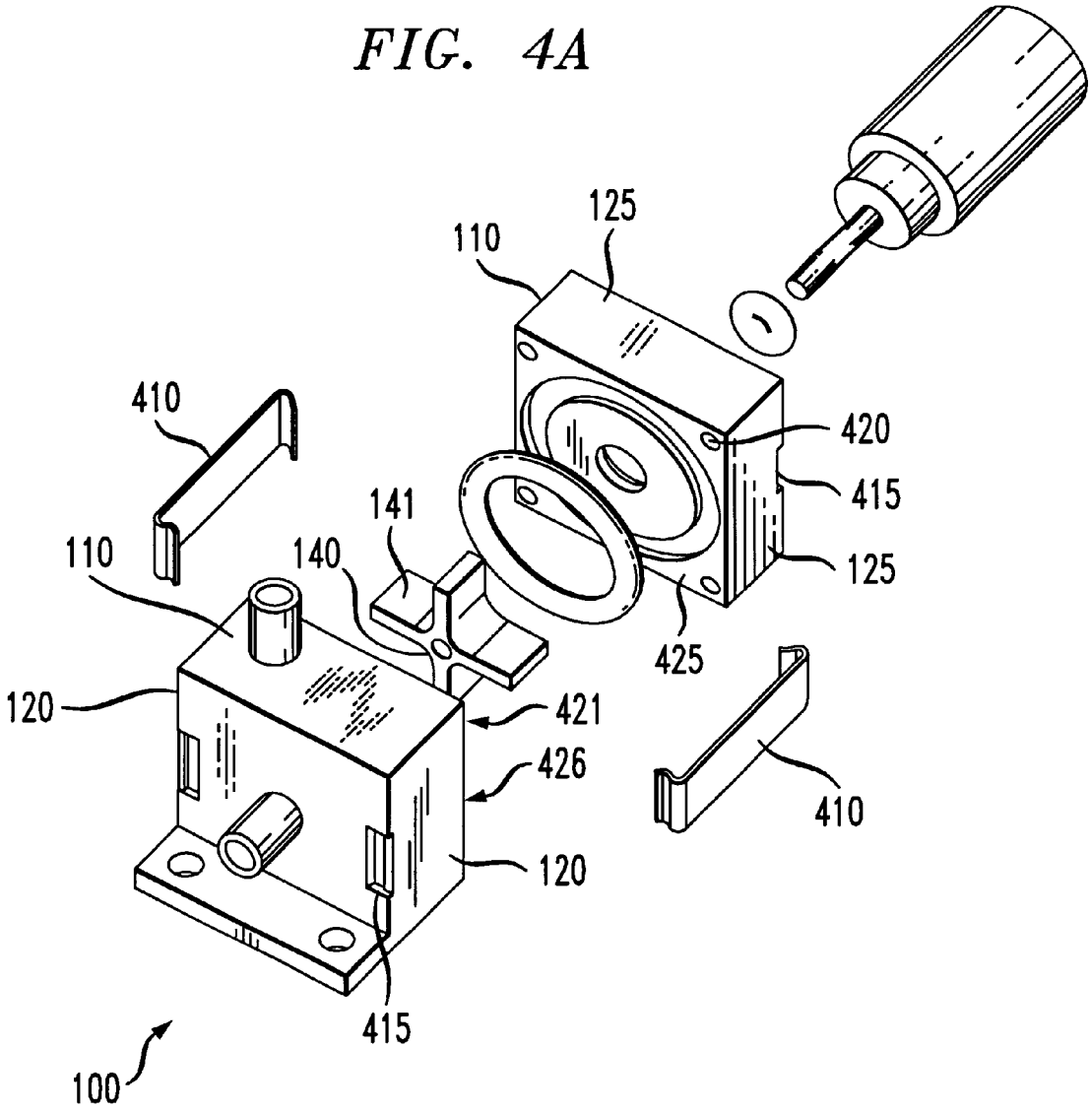
FIG. 4A illustrates an exploded isometric view of an embodiment of the miniature liquid transfer pump where the first and second blocks are joined together by clips.

Turning now to FIG. 4A, illustrated is an exploded isometric view of an embodiment of the miniature liquid transfer pump 100 where the first and second blocks 120, 125 are joined together and are fastened by clips 410. The first and second blocks 120, 125 each have a clip receptacle 415 to receive and secure the clips 410 when the housing 110 is assembled.

Also illustrated in FIG. 4A is another optional feature that assists in assuring that the first and second blocks 120, 125 register properly when joined. In this embodiment, an alignment feature 420 is located on a surface 425 of one of the first 120 and second blocks 125 (in this instance, the second block 125) that is joinable to a surface 426 (not visible) of the other of the first 120 or second 125 blocks (in this instance, the first block 120) which has a corresponding alignment feature receptacle 421 (not visible). The alignment feature 420 and alignment feature receptacle 420 assist in assembling the housing 110 by providing a positive indication that the first and second blocks 120, 125 are correctly aligned. The alignment feature 420 also provides additional support to the housing 110 by preventing rotation or separation when opposing torques are applied to the first and second blocks 120, 125, respectively.

Also illustrated in FIG. 4A is a feature that provides for the impeller 140 to have a vane 141 that is flat. This contrasts with art vanes art used in larger pumps where the blades are typically curved.

Figure 4B:
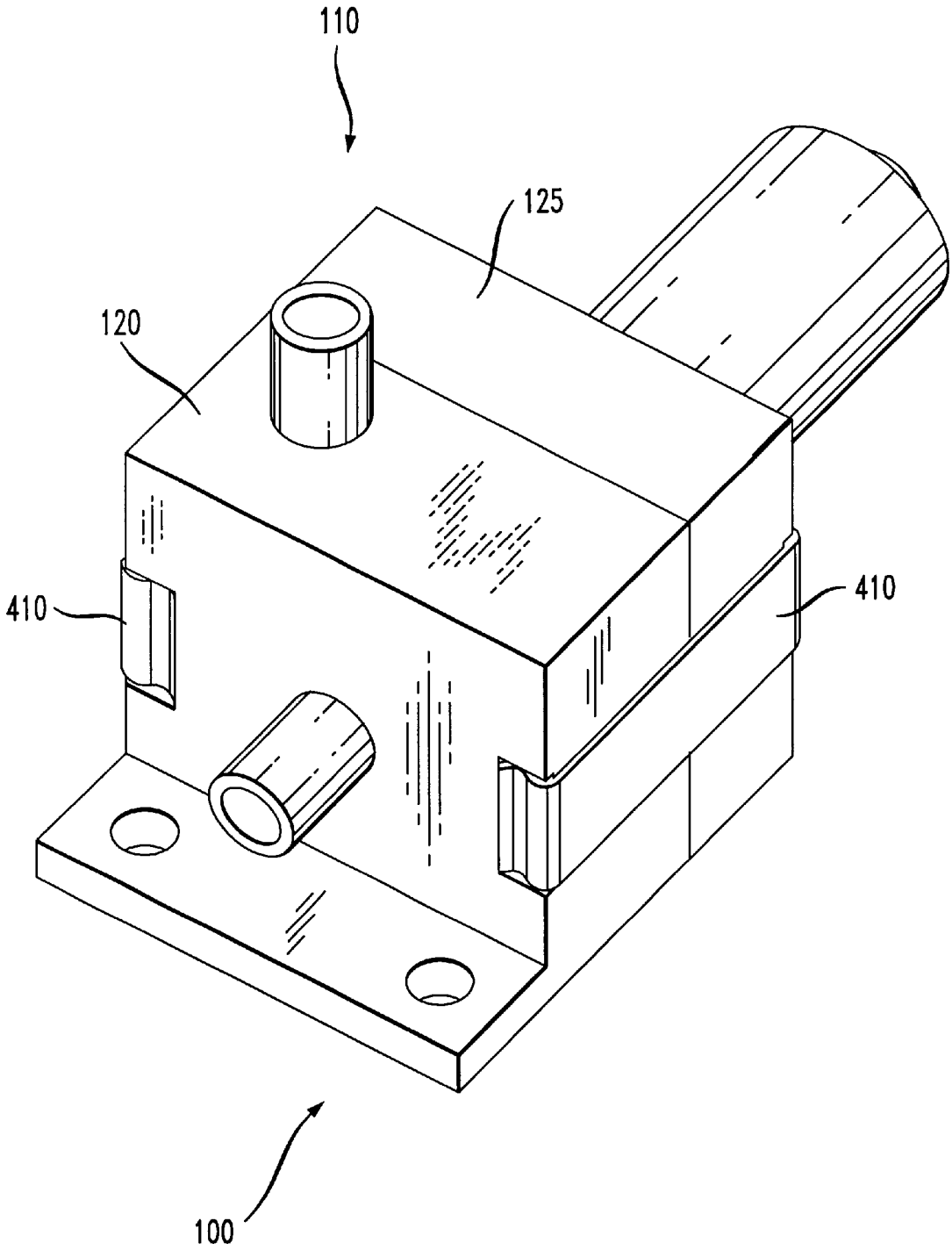
FIG. 4B illustrates an assembled isometric view of the miniature liquid transfer pump of FIG. 4A.

Turning to FIG. 4B, illustrated is the pump 100 of FIG. 4A as assembled. As described above, the first and second blocks 120, 125 are secured to one another by clips 410. The assembled pump 100 in FIG. 4B illustrates a housing 110 that has a block shape. In one embodiment of the invention the block-shaped housing 110 is constructed so that each side of the housing is less than about one inch long.

Figure 5A:
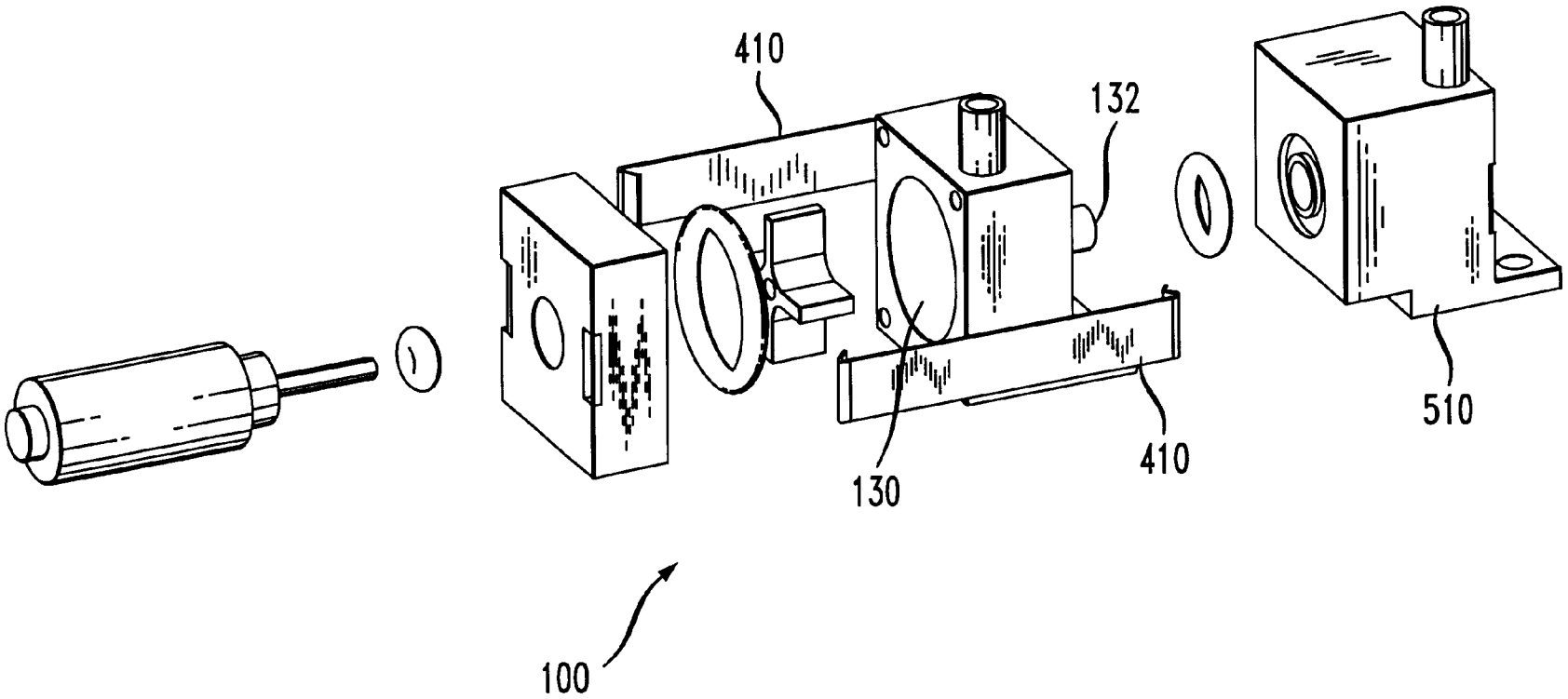
FIG. 5A illustrates an exploded isometric view of an embodiment of a miniature liquid transfer pump incorporating a fluid reservoir.
Figure 5B:
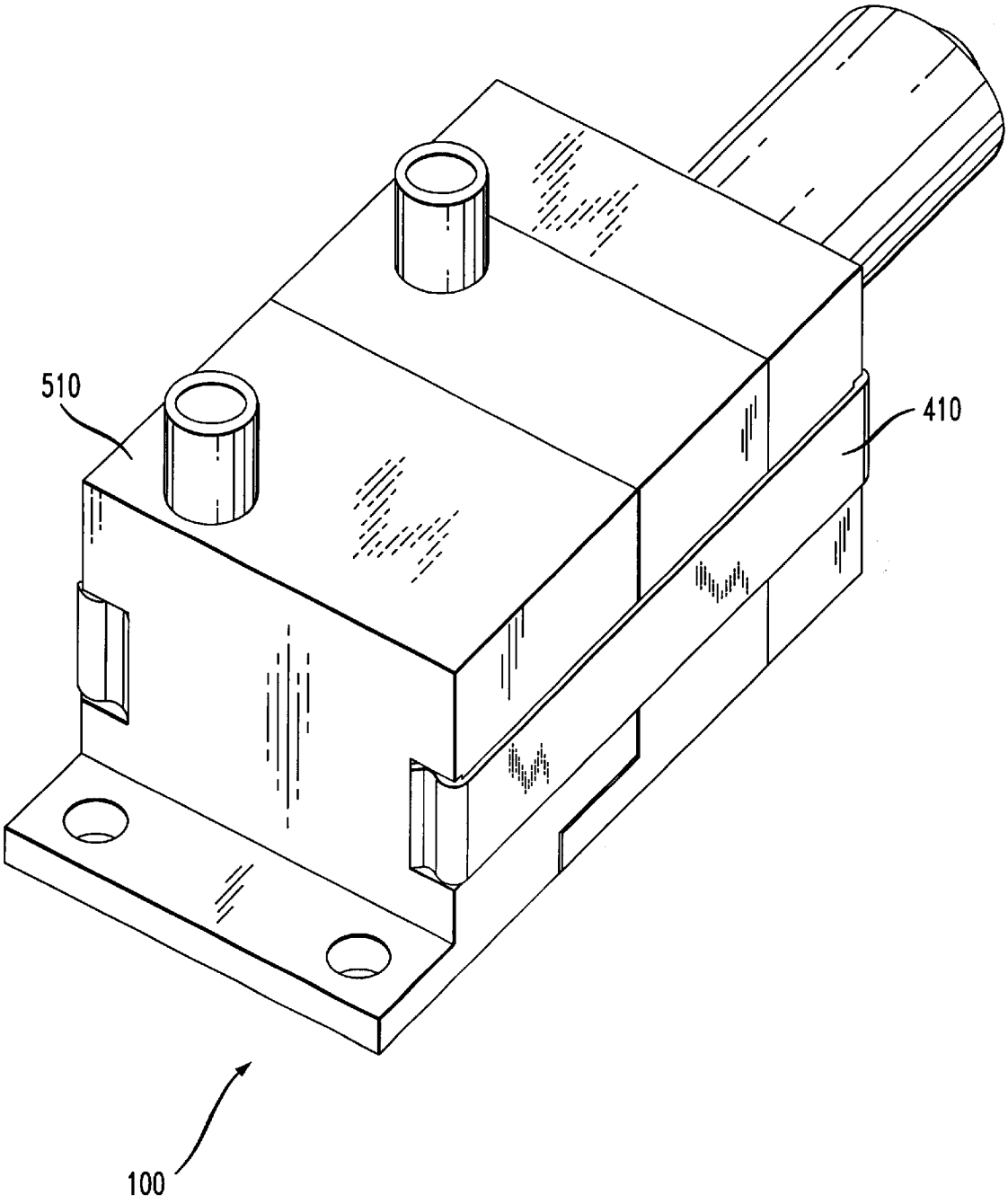
FIG. 5B illustrates an assembled isometric view of the miniature liquid transfer pump and fluid reservoir of FIG. 5A.

Turning now to FIG. 5A, illustrated is an exploded isometric view of an embodiment of a miniature liquid transfer pump 100 incorporating a fluid reservoir 510 in its construction. In this embodiment of the invention, a fluid reservoir 510 is coupled to the impeller chamber 130 inlet 132. The reservoir 510 acts as a buffer to regulate the flow of fluid passing through the pump 100. The illustrated pump 100 is held together by clips 410. Illustrated in FIG. 5B is an assembled view of the pump 100 and a fluid reservoir 510 as held together by clips 410.

Figure 6:
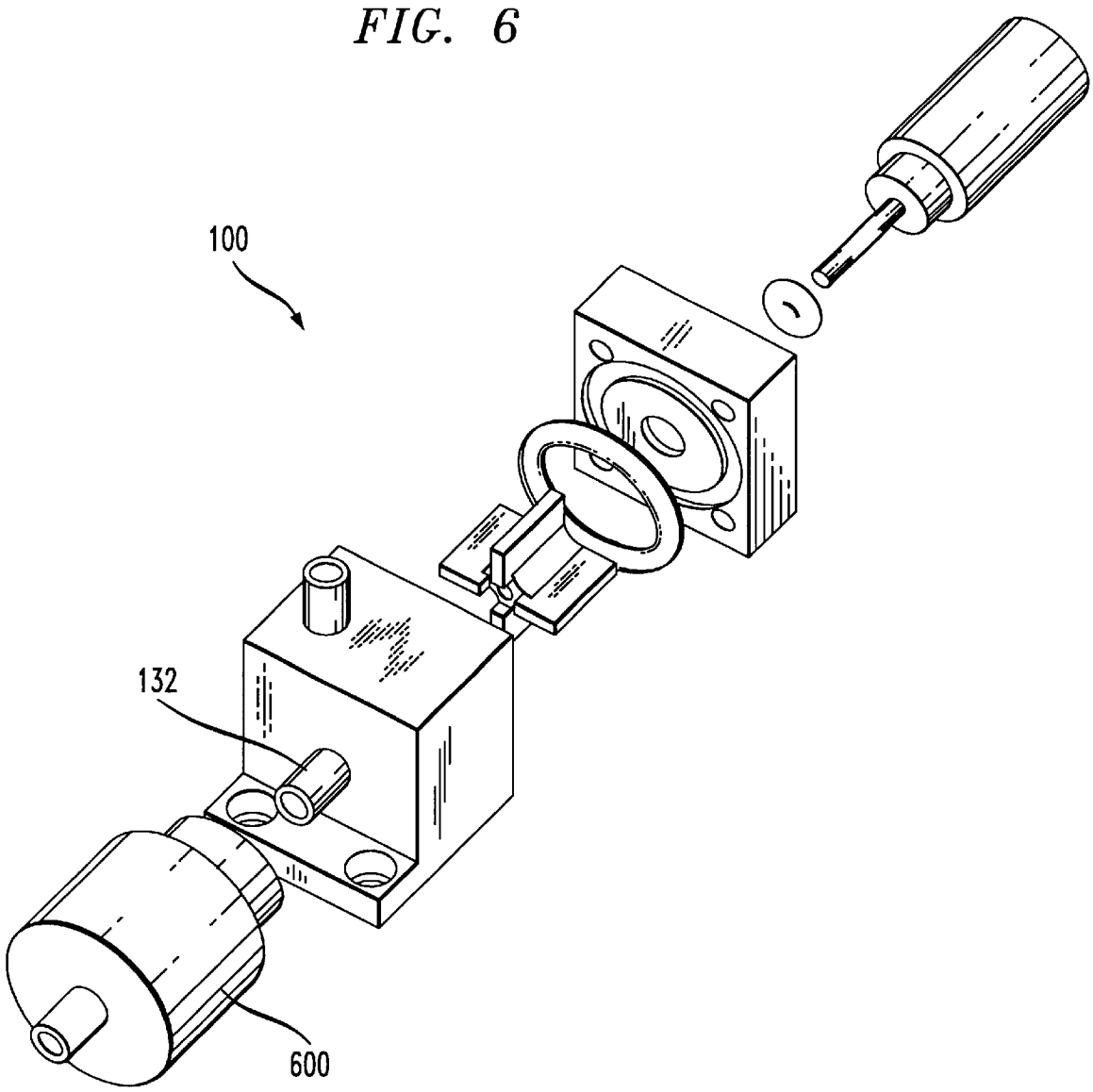
FIG. 6 illustrates an exploded isometric view of an embodiment of a miniature liquid transfer pump incorporating a cylindrical fluid reservoir configuration.

Turning to FIG. 6, illustrated is an exploded isometric view of an embodiment of a miniature liquid transfer pump 100 incorporating an alternative fluid reservoir 510 configuration. The illustrated fluid reservoir 600 is cylindrical, rather than block-shaped, as FIGS. 5A and 5B illustrated.

Those skilled in the pertinent art will understand that any type of reservoir configuration coupled to the inlet 132, whether now known or designed at a later date, is within the intended scope of the present invention.

Figure 7:
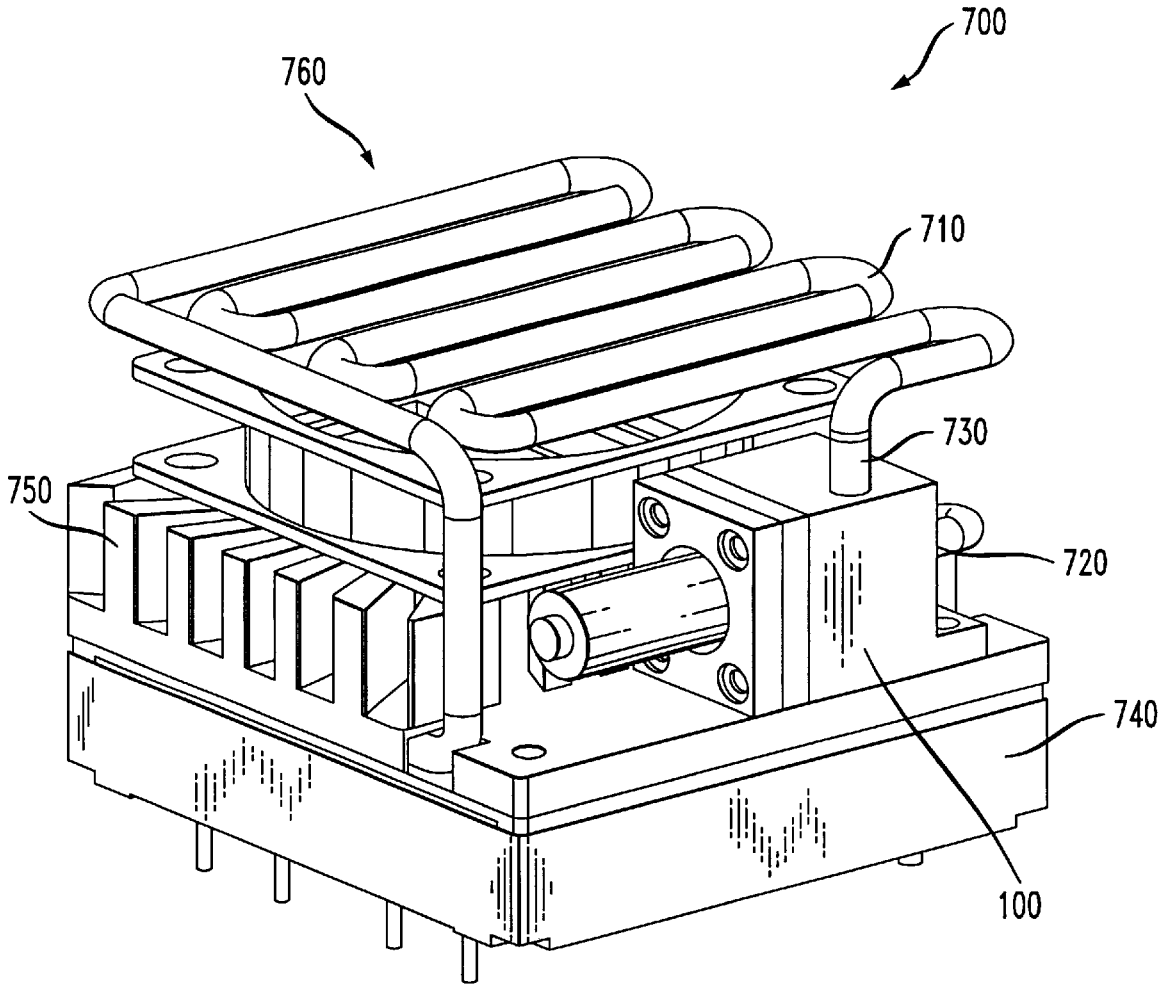
FIG. 7 illustrates an isometric view of a liquid transfer device employable to cool an electronic component.

Turning now to FIG. 7, illustrated is a liquid transfer device 700 for transporting liquid. The liquid transfer device 700 has a pipe 710 with a destination end 720 and a source end 730. Coupled to the pipe 710 is an embodiment of a miniature liquid transfer pump 100, as described herein. The illustrated liquid transfer device 700 is used in an active cooling mechanism for controlling heat generated by an electronic component 740, to which the device 700 is coupled. The pump 100 circulates liquid coolant through a heat sink 750, where heat emitted by the electronic device 740 is gathered, and then through a heat radiation section 740 where the heat is dissipated into the surrounding ambient air. The illustrated active cooling mechanism is described in detail in co-pending U.S. patent application Ser. No. 09/482,839, entitled "Integrated Active Liquid Cooling Device For Board Mounted Electronic Components," filed on Jan. 13, 2000, to Chen, et. al., commonly assigned with the invention and incorporated herein by this reference.

Although the present invention has been described in detail, those skilled in the art should understand that they can make various changes, substitutions and alterations herein without departing from the spirit and scope of the invention in its broadest form.

What is claimed is:

1. A miniature liquid transfer pump, comprising:

a housing including first and second substantially rectilinear blocks joinable to form a leak-resistant impeller chamber having a drive shaft aperture, an inlet and an outlet;

a fluid reservoir coupled to said inlet, said reservoir secured to said housing with a clip;

an impeller located in said impeller chamber; and a motor having a drive shaft extending therefrom, that is mounted to said housing such that said drive shaft passes through said drive shaft aperture and engages said impeller to drive said impeller thereby to draw liquid through said inlet and eject said liquid through said outlet.

2. The pump as recited in claim 1 wherein said impeller has a vane with a notch thereon.

3. The pump as recited in claim 1 wherein said impeller has a flat vane.

4. The pump as recited in claim 1 further comprising a sealing plate on said impeller, said sealing plate transversely oriented to the rotational axis of said impeller.

5. The pump as recited in claim 1 further comprising a mounting plate having a mounting plate aperture therein, said mounting plate coupled to said housing adjacent said motor such that said drive shaft passes through said mounting plate aperture before passing through said drive shaft aperture.

6. The pump as recited in claim 1 wherein an alignment feature is located on a surface of one of said first and second blocks joinable to a surface of the other of said first and second blocks with an alignment feature receptacle located thereon.

7. The pump as recited in claim 1 further comprising a clip securing said first and second blocks together.

8. The pump as recited in claim 1 wherein each of said first and second blocks has a dimension of less than about one inch.

9. A method of manufacturing a miniature liquid transfer pump, comprising:

forming a housing that includes first and second substantially rectilinear blocks joinable to form a leak-resistant impeller chamber having a drive shaft aperture, an inlet and an outlet;

coupling a fluid reservoir to said inlet and securing said reservoir to said housing with a clip;

forming an impeller to be located in said impeller chamber; and providing a motor having a drive shaft extending therefrom, that is mounted to said housing such that said drive shaft passes through said drive shaft aperture and engages said impeller to drive said impeller thereby to draw liquid through said inlet and eject said liquid through said outlet.

10. The method as recited in claim 9 wherein said impeller has a vane with a notch thereon.

11. The method as recited in claim 9 wherein said impeller has a flat vane.

12. The method as recited in claim 9 further comprising a forming a sealing plate on said impeller, said sealing plate transversely oriented to the rotational axis of said impeller.

13. The method as recited in claim 9 further comprising a forming a mounting plate having a mounting plate aperture therein, and coupling said mounting plate to said housing adjacent said motor such that said drive shaft passes through said mounting plate aperture before passing through said drive shaft aperture.

14. The method as recited in claim 9 wherein an alignment feature is formed on a surface of one of said first and second blocks joinable to a surface of the other of said first and second blocks with an alignment feature receptacle located thereon.

15. The method as recited in claim 9 further comprising providing a clip securing said first and second blocks together.

16. The method as recited in claim 9 wherein each of said first and second blocks has a dimension of less than about one inch.

17. For transporting liquid, a liquid transfer device, comprising;

a pipe having a source end and a destination end; and a miniature liquid transfer pump coupled to said pipe, said pump, including:

a housing including first and second substantially rectilinear blocks joinable to form a leak-resistant impeller chamber having a drive shaft aperture, an inlet and an outlet;

a fluid reservoir coupled to said inlet, said reservoir secured to said housing with a clip;

an impeller located in said impeller chamber; and a motor having a drive shaft extending therefrom, that is mounted to said housing such that said drive shaft passes through said drive shaft aperture and engages said impeller to drive said impeller thereby to draw said liquid through said inlet and eject said liquid through said outlet.

18. The device as recited in claim 17 wherein said impeller has a vane with a notch thereon.

19. The device as recited in claim 17 wherein said impeller has a flat vane.

20. The device as recited in claim 17 further comprising a sealing plate on said impeller, said sealing plate transversely oriented to the rotational axis of said impeller.

21. The device as recited in claim 17 further comprising a mounting plate having a mounting plate aperture therein, said mounting plate coupled to said housing adjacent said motor such that said drive shaft passes through said mounting plate aperture before passing through said drive shaft aperture.

22. The device as recited in claim 17 wherein an alignment feature is located on a surface of one of said first and second blocks joinable to a surface of the other of said first and second blocks with an alignment feature receptacle located thereon.

23. The device as recited in claim 17 further comprising a clip securing said first and second blocks together.

24. The device as recited in claim 17 wherein each of said first and second blocks has a dimension of less than about one inch.

* * * * *